US009173459B2

(12) United States Patent
Gisser et al.

(10) Patent No.: US 9,173,459 B2
(45) Date of Patent: Nov. 3, 2015

(54) CLIP FOR AN ORNAMENTAL ITEM

(76) Inventors: Laura Jane Gisser, Watchung, NJ (US); Roxana Adrienne Surrey, Tenafly, NJ (US)

( * ) Notice: Subject to any disclaimer, the term of this patent is extended or adjusted under 35 U.S.C. 154(b) by 1891 days.

(21) Appl. No.: 11/680,270

(22) Filed: Feb. 28, 2007

(65) Prior Publication Data

US 2007/0251268 A1 Nov. 1, 2007

Related U.S. Application Data

(60) Provisional application No. 60/745,792, filed on Apr. 27, 2006.

(51) Int. Cl.
*A44C 1/00* (2006.01)
*A44C 5/20* (2006.01)

(52) U.S. Cl.
CPC ..... *A44C 1/00* (2013.01); *A44C 5/2095* (2013.01); *Y10T 24/44444* (2015.01); *Y10T 24/44556* (2015.01); *Y10T 24/44932* (2015.01)

(58) Field of Classification Search
CPC .... A44C 1/00; A44C 15/0045; A44C 15/005; A44C 25/00; Y10T 24/44444; Y10T 24/44556; Y10T 24/44932
USPC ..... 63/20, 21, 43, 14.4, 14.5, 1.11, 14.3, 63/23, 33; 132/273, 144, 276; 24/507, 24/520, 564, 571
See application file for complete search history.

(56) References Cited

U.S. PATENT DOCUMENTS

| | | | | | |
|---|---|---|---|---|---|
| 2,930,209 | A * | 3/1960 | Altman | 63/1.16 |
| 3,225,565 | A * | 12/1965 | Bohlinger et al. | 63/3.2 |
| 3,271,977 | A * | 9/1966 | Bohlinger et al. | 63/3.2 |
| 3,983,716 | A * | 10/1976 | Kuhn | 63/38 |
| 4,084,299 | A * | 4/1978 | Noda | 24/504 |
| 4,573,243 | A * | 3/1986 | Plaza | 24/116 A |
| 4,722,120 | A * | 2/1988 | Lu | 24/489 |
| 5,687,585 | A * | 11/1997 | Ferrell | 63/21 |
| 6,019,108 | A * | 2/2000 | Chen | 132/276 |
| 6,311,699 | B1 * | 11/2001 | Horman | 132/278 |
| 6,393,675 | B1 * | 5/2002 | Gaetke | 24/563 |
| 6,742,228 | B1 * | 6/2004 | Kim | 24/507 |
| 7,290,687 | B2 * | 11/2007 | Wu | 223/96 |

* cited by examiner

*Primary Examiner* — Emily Morgan
(74) *Attorney, Agent, or Firm* — William Squire; G. Glennon Troublefield

(57) ABSTRACT

The present invention is directed to a clip for attaching an ornamental item to an article. The clip includes a base having an ornamental surface and an attachment device secured to said base for movement between a first position and a second position relative to said base to open and close the clip to engage a portion of an article therebetween. A plurality of projections are secured to said base, wherein each projection projects toward said attachment device to engage a portion of the article therebetween. At least one of the projections has a layer of relatively soft, elastomeric friction engaging material to enhance the grasping capabilities of the clip, without damaging the article.

8 Claims, 7 Drawing Sheets

CLIP FOR AN ORNAMENTAL ITEM

REFERENCE TO PRIOR APPLICATION

This application claims the benefit of U.S. Provisional Application No. 60/745,792, filed on Apr. 27, 2006, entitled "A Clip For An Ornamental Item," in the name of Laura Jane Gisser and Roxana Adrienne Surrey.

FIELD OF THE INVENTION

The present invention relates to attachment devices. In particular, the present invention relates to an ornamental clip for an article, particularly jewelry.

BACKGROUND OF THE INVENTION

Decorative items, such as jewelry, pins, brooches and the like are well known. Individuals wear jewelry on different parts of their body or clothing primarily to enhance their overall outward appearance. For example, women often wear a necklace around their neck or a bracelet around their wrist. The necklace is typically worn for decorative purposes, to add to the attractiveness of the wearer to observers. Other forms of jewelry are used as accessories to make a particular article of clothing more attractive.

Women are also known to use enhancers as decorative fashion accessories for necklaces. Enhancers are relatively small, discrete pieces of decorative jewelry that are either locked or slid onto a specific central position of the necklace. Enhancers are typically manufactured to attach to a specific necklace using prior art clamps or fasteners. However, the size, shape and dimensions of prior art fasteners prevent enhancers from being used with different types of necklaces or positioned other than in the center. As a result, enhancers manufactured in accordance with prior art standards give women little, if any, option to use the enhancer with other forms of jewelry or necklaces.

Decorative cables for necklaces are used in the jewelry industry in place of enhancers. Decorative cables typically include a male/female snap-together-end, in which a pendant is designed to snap onto the decorative cable. The cable, in turn, is designed to attach to the center of the necklace. Once the decorative cable is attached, it cannot be moved or relocated from the center position. As a result, the snap-together cable design suffers from the same limitations or restrictions as enhancers, in that the cable/pendant can be only attached to one center position on the necklace. The lack of freedom in positioning the cable/pendant on the necklace limits the user's ability to control how the necklace and cable/pendant combination is worn. In a word, most prior art jewelry, such as enhancers or decorative cable/pendant combinations, are not adapted to be interchanged with or attached to different types jewelry.

As another example, decorative items that include pins as fasteners are ill-suited to attach to jewelry. For instance, a decorative item, such as a brooch, typically includes a decorative portion that is attached in some form to a pin. Most prior art pins are not manufactured or designed to engage odd-shaped, relatively hard surfaces, which is present in most forms of jewelry. When a user attempts to maneuver the pin to attach a piece of jewelry to a string of pearls, the needle will either bend, break, or dislodge itself from the hinge or catch, thereby permanently damaging the pin and, in some cases, the string of pearls. The individual pearls are either too hard for a pin to pierce or wrap around to engage the catch. Also, using the pin on other pieces of jewelry, such as a chocker, can result in piercing the wearer's skin because the sharp needle end of the pin will remain exposed and close to the user's body. Furthermore, pins are known to damage clothing by creating small holes in the fabric. These small holes can become unsightly and ruin an article of clothing.

Accordingly, it is an object of the present invention to provide an attachment device for an ornamental/decorative item, which can be maneuvered to attach to a variety articles and contact surfaces. It is also an object of the present invention to provide an attachment device for an ornamental item that can be attached to an article a different positions desired by the user. It is a further object of the present invention to provide a clip for an ornamental item that is easy to use and is relatively inexpensive to manufacture. In addition, it is an object of the present invention to provide an ornamental clip that can be worn as a fashion accessory on articles, such as pearls, beads, scarves, handbags, jewelry and the like.

SUMMARY OF THE INVENTION

The present invention is directed to a clip for attaching an ornamental item to an article. The clip comprises a base having an ornamental surface. An attachment device is secured to said base for movement between a first position and a second position relative to said base to open and close the clip to engage a portion of an article therebtween. A plurality of projections on said base project toward said attachment device to engage a portion of the article therebetween. In a preferred embodiment, at least one of the projections includes a layer of relatively soft, friction engaging material to grasp but not scratch the portion of the article engaged.

BRIEF DESCRIPTION OF THE DRAWINGS

For purposes of illustrating the invention, there is shown in the drawings a form which is presently preferred; it being understood, however, that this invention is not limited to the precise arrangements and embodiments shown.

Figure 1:
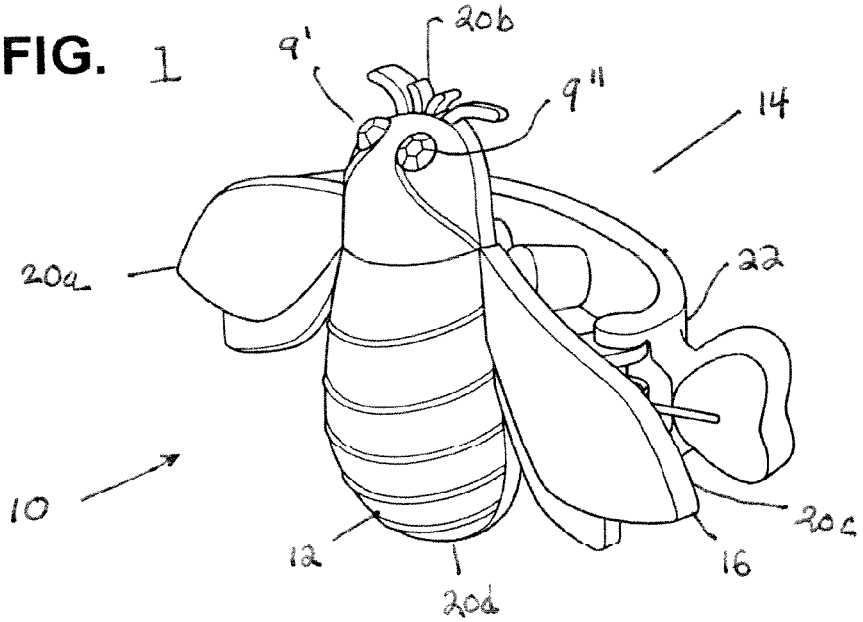
FIG. 1 is a perspective view of an exemplary clip having an attachment device of the present invention.
Figure 5:
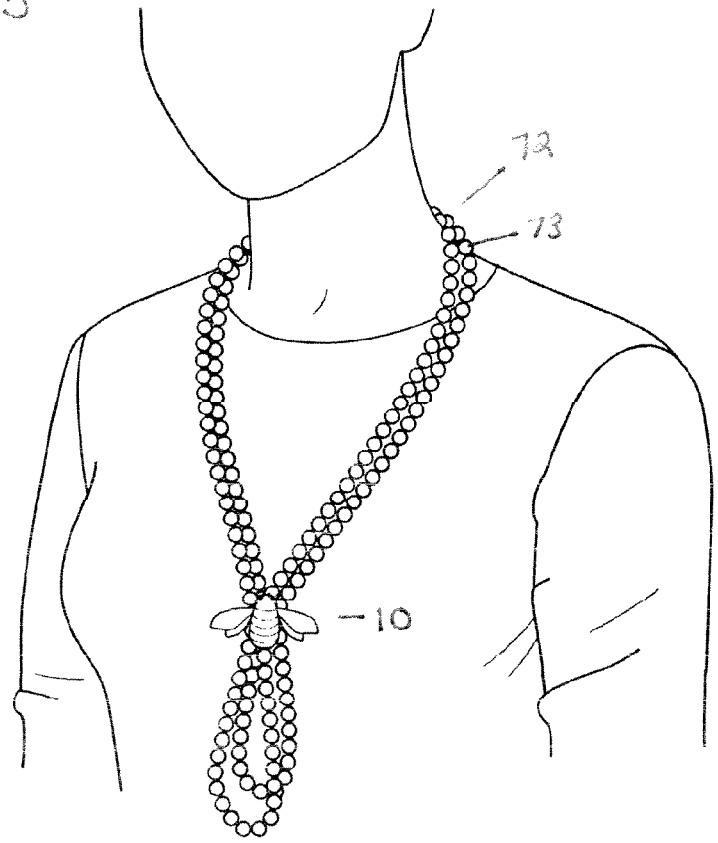
Figure 4:
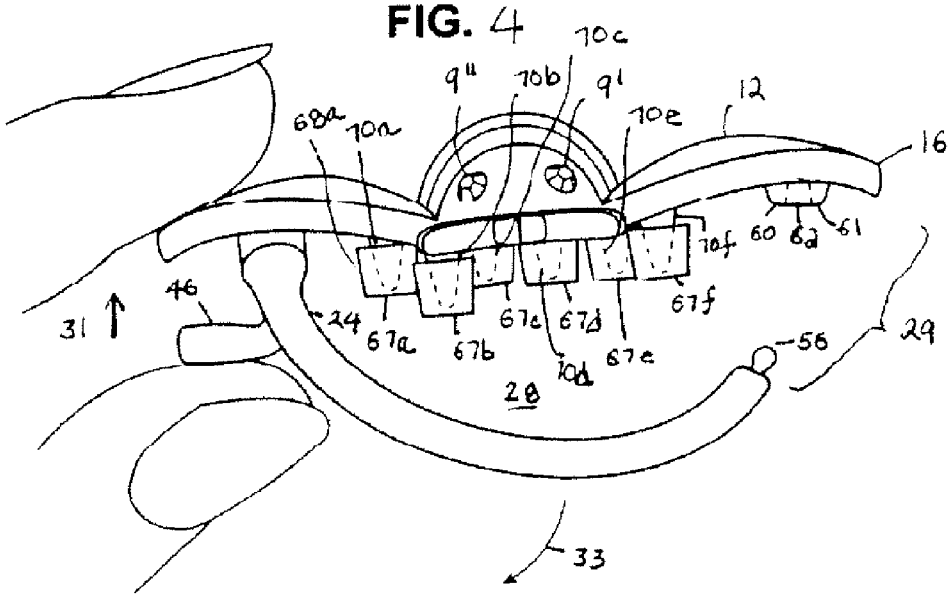
FIG. 4 is a top plan view of the clip shown in FIG. 1 in an open position.

FIG. **4*a* is similar to FIG. 4**, but shows one portion of the projections as having a layer of elastomeric material thereon and another portion of the projections with no layer thereon;

FIG. 5 is a perspective view of the clip shown in FIG. 1, attached to an exemplary string of pearls.

Figure 6:
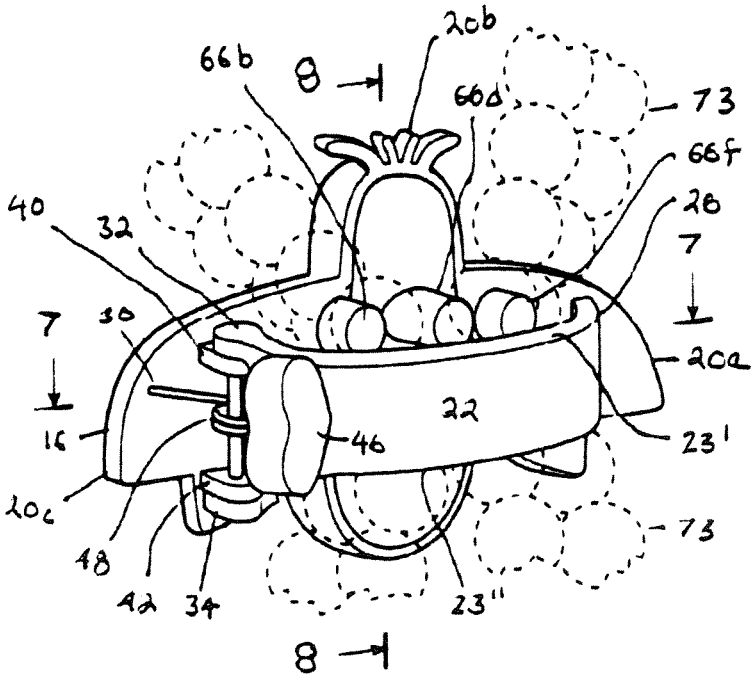

FIG. 6 is a rear perspective view of the clip shown in FIG. 5 in a closed position, attached to a portion of the pearls (which are shown in phantom).

Figure 7:
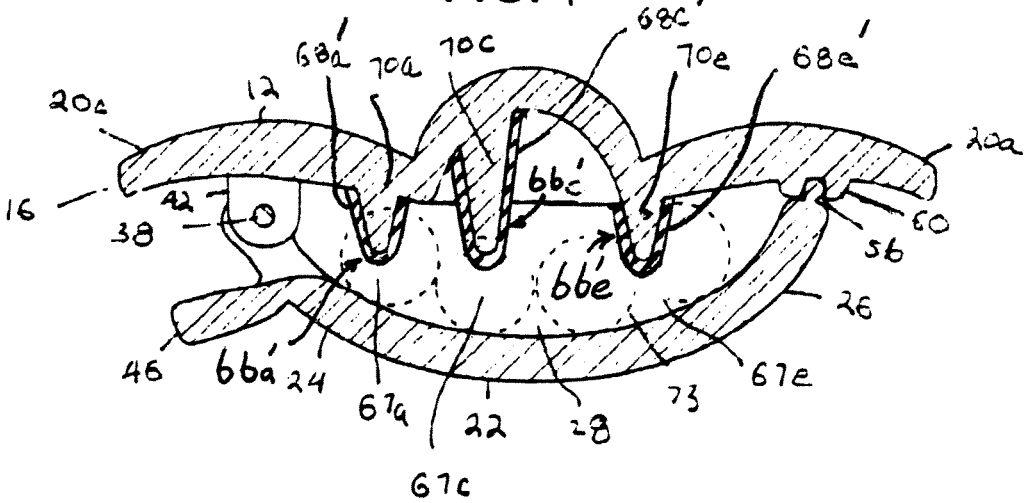

FIG. 7 is a cross-sectional view of the clip shown in FIG. 6, taken along line 7-7.

Figure 8:
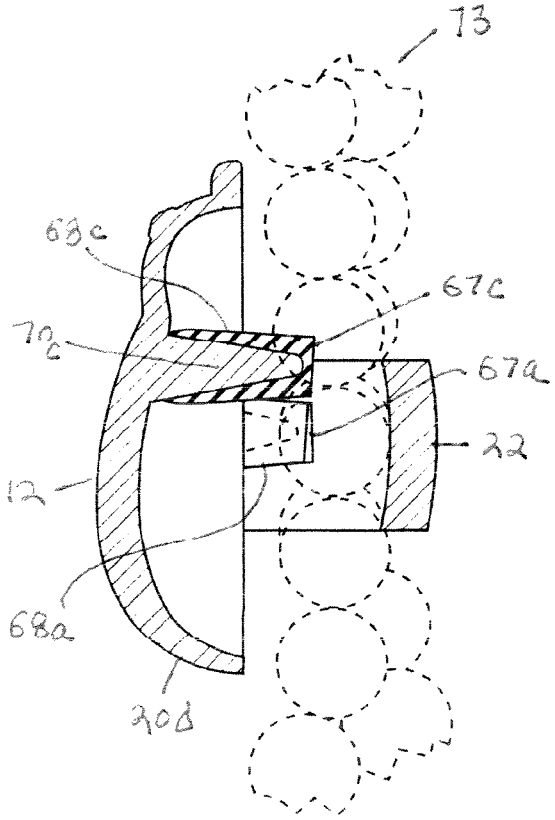

FIG. 8 is a cross-sectional view of the clip shown in FIG. 6, taken along line 8-8.

Figure 9:
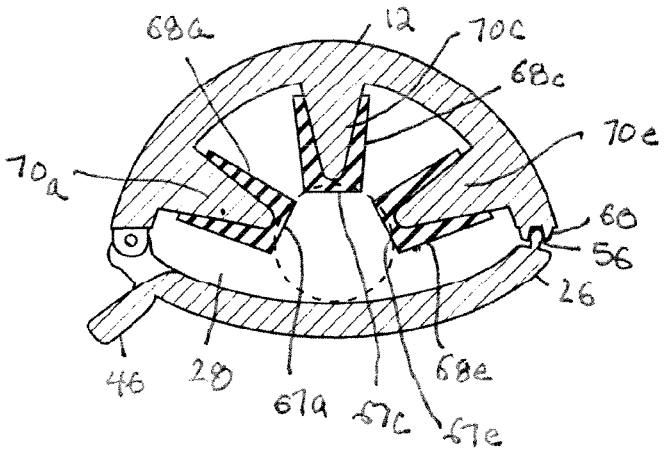

FIG. 9 is a cross-sectional view of the clip shown in FIG. 6, illustrating three projections engaging one of the pearls.

Figure 10:
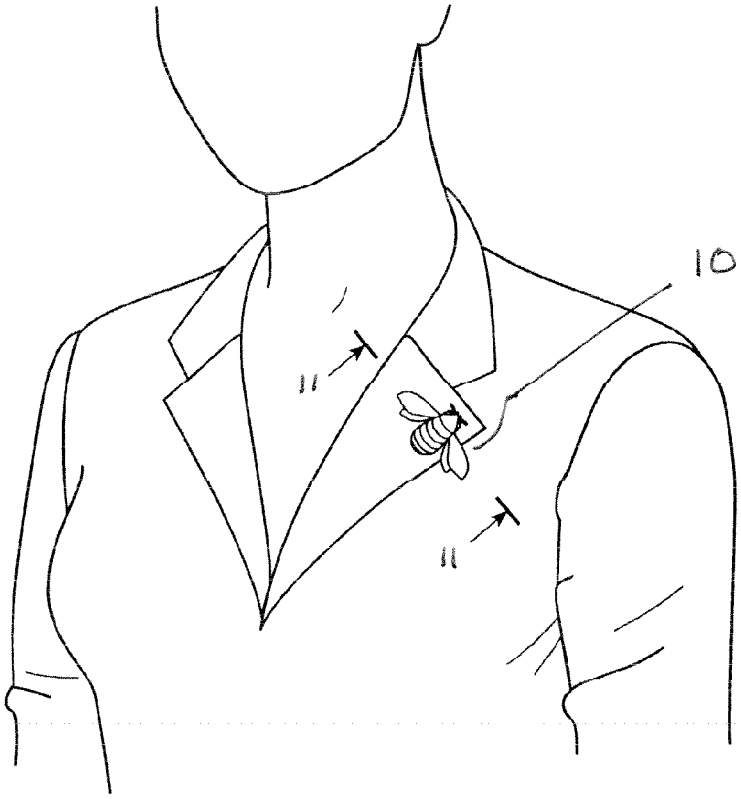

FIG. 10 is a perspective view of the clip shown in FIG. 1, attached to an exemplary jacket or blouse.

Figure 11:
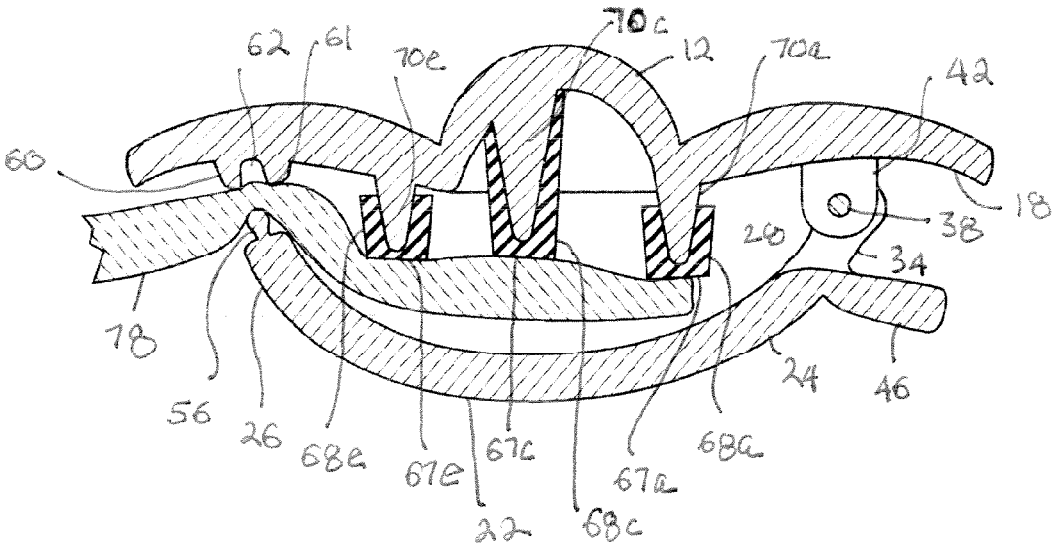

FIG. 11 is a cross-sectional view of the clip shown in FIG. 10, taken along line 10-10.

DETAILED DESCRIPTION OF THE INVENTION

In the drawings, wherein like reference characters identify like elements, there is shown an embodiment of a fastener of the present invention, in the form of a clip 10. The clip 10 is used to releasably, but firmly attach an ornamental/decorative item to an article, such as a necklace, a bracelet, a scarf, articles of clothing, a pocket book and the like. The clip 10 can be used for articles ranging from items having relatively small or odd shaped contact surfaces (such as beads or links of jewelry) to items made of hard or relatively soft material, such as scarves, jackets, skirts, blouses, curtains, napkins and the like. The clip 10 is decorative and can be manufactured in any form, shape or size that is desired. Accordingly, it should be understood that the clip 10 is not limited to the specific embodiments illustrated in the drawings.

As shown in FIG. 1, the clip 10 includes an ornamental face 12 and an attachment device 14. The ornamental face 12 forms an outer exposed decorative portion of the clip 10, having either a two or three-dimensional shape. The ornamental face 12 is made of durable material, such as metal, plastic, precious stones, alloys and the like or any combination thereof. When manufactured as a piece of jewelry, the ornamental face 12 includes precious metal, such as gold, silver or platinum, interlaced with precious stones (real or costume) or any combination thereof. The exemplary ornamental face 12 illustrated in FIG. 1 is a bumble-bee, having a pair of precious stones 9' and 9" which are used to represent the eyes of the bumble-bee.

The ornamental surface 12 can be any size, shape or color and simulate or create the appearance of any object, animal, insect, person or thing that is desired. The ornamental face 12 may include artwork, graphic indicia, color schemes, precious stones or the like to contribute toward the overall attractiveness and theme of the clip 10. If desired, the ornamental face 12 can be eliminated altogether and replaced with a plain surface. However, the form illustrated in the drawings is presently preferred.

Figure 2:
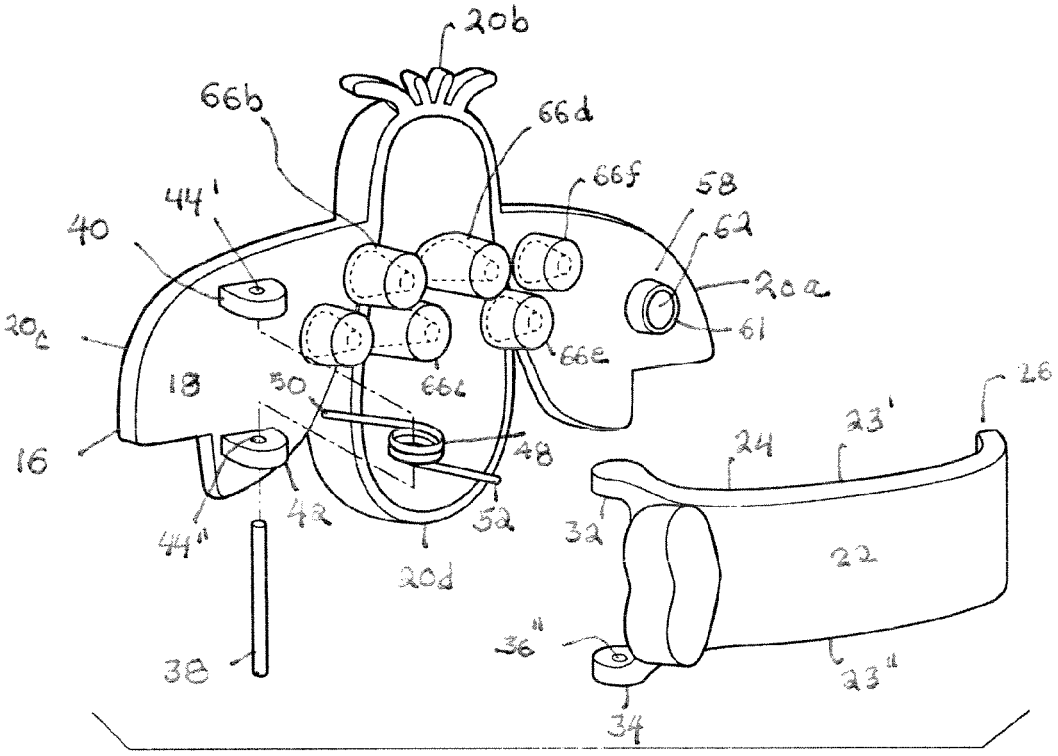
FIG. 2 is an exploded rear perspective view of the clip shown in FIG. 1, showing a locking arm of the attachment device relative to a group of projections.

As shown in FIGS. 1 and 2, the ornamental face 12 is joined to a mounting base 16. The base 16 is integrally formed with, or may be separate from, the ornamental face 12. The base 16 is preferably thematically related to the ornamental face 12, in that the sides of the base are preferably shaped and dimensioned to correspond to and complement the theme of the clip 10. The base 16 includes an exposed, rear or back surface 18, terminating in sides 20*a*, 20*b*, 20*c*, and 20*d* that further define the shape an appearance of the clip 10. The surface 18 is relatively smooth, but is not necessarily planar. As shown in FIG. 2, the surface 18 and sides (20*a*, 20*b*, 20*c* and 20*d*) are shaped to correspond to the shape of the ornamental face 12 to complete the appearance and theme of the clip 10 as a bumble bee.

The attachment device 14 is movably secured to the base 16, (e.g., pivotably mounted as viewed). The attachment device 14 is a type of fastener, which is adapted for movement between a first position and a second position, relative to the base 16, to open and close the clip 10 so that a portion of the article can be engaged therebetween. The first position can be the open or closed position or it can represent any starting point of the movement of the attachment device 14 or of the movement of the components of the attachment device 14, as further explained. Likewise, the second position can be the open or closed position or it can represent any ending point of the operation of the attachment device 14 or of the movement of the components of the attachment device 14.

The attachment device 14 includes an operable locking mechanism, in the form of an arm 22. The locking arm 22 is a relatively thin, but durable lever which may be made from the same or different material used for the base 16. The locking arm 22 has a proximal end 24 that is joined to a free distal end 26 by opposed sides 23' and 23" which define its length. The free end 26 of the locking arm 22 defines the mouth of the clip 10.

Preferably, the locking arm 22 is arcuate, defining an attachment region 28 of the clip 10, as best seen in FIG. 4. Access to region 28 is gained through an opening 29 of the mouth of the clip 10. The opening 29 has a magnitude or size that can be expanded or reduced to releasably attach the clip 10 to a portion of an article. The ability to control the size of the opening 29 is advantageously used to fasten the clip 10 to objects and articles having different shapes, sizes, textures, and contact surfaces.

As best seen in FIGS. 2, 4 and 6, the locking arm 22 is pivotably mounted to the base 16 by a mounting brace 30. The mounting brace 30 is formed by a pair of spaced apart legs 32 and 34 that are joined to the proximal end 24 of the locking arm 22. Each leg 32 and 34 includes a co-axial recess 36' (not shown) and 36" that are mirror images of one another. Recesses 36' and 36" are shaped and dimensioned to rotatably and slidably receive a pivot pin 38. Pivot pin 38 is provided so that the locking arm 22 can rotate as needed to open and close the mouth or opening 29 of the clip 10.

During assembly, pivot pin 38 is inserted through pivot mounts 40 and 42, each having a through hole 44' or 44", respectively, that are mirror images of each other. Pivot mounts 40 and 42 are spaced apart to slidably engage legs 32 and 34. As shown in FIG. 6, pivot mounts 40 and 42 are positioned inward of legs 32 and 34 so that the legs 30 and 32 will slide over the outer exposed surface of the mounts 40 and 42 when the clip 10 is assembled. The pivot mounts 40 and 42 may be positioned so that legs 32 and 34 will slide over the inward facing surface of the mounts 40 and 42. In that type of embodiment, the legs 32 and 34 will have through holes and the mounts 40 and 42 will have recesses to receive pivot pin 38.

Pivot pin 38 is held in place by sliding legs 32 and 34 over mounts 40 and 42, respectively, which then allows the locking arm 22 to rotate or move between an open position/condition (as shown in FIG. 4) and a closed or partially closed position/condition (as shown in FIGS. 4 and 6, respectively). Operating the locking arm 22 controls the magnitude of the opening 29 that is desired by the user.

The locking arm 22 is operated by an actuator 46. The actuator 46 is an integrally or separately formed lever that is joined to the locking arm 22. The actuator 46 should be positioned slightly above the mounting brace 30, extending away from the locking arm 22. The size and distance in which the actuator 46 extends creates a cantilever effect such that the actuator 46 can be pushed toward the base 16, along direction arrow 31 (toward the top of the paper). Pushing the actuator 16 toward the base 16 causes the distal end 26 of the locking arm 22 to rotate about pivot mounts 40 and 42 away from the base 16 along direction arrow 33 (clockwise). The rotation of the free end 26 of the locking to a desired open position, opens the mouth of the clip 10. Although the actuator 46, as best seen in FIG. 2, is heart shaped, it should be understood that the actuator 46 can be any shape or size that is desired and, in the alternative, can be thematically related to the clip 10.

The locking arm 22 is shown in the drawings as a sold bar. However, it is contemplated that the locking arm can be any shape, size or dimension. The locking arm 22 can include artwork, graphic indicia or have an ornamental face or appearance. For example, the locking arm 22 can have a decorative artistic structure, such as a series of heart shaped members secured to the sides by a pair of curved or arcuate bars (not shown). In addition, the locking arm can be thematically related to the ornamental face 12 of the clip 10 to add to or complete the theme of clip 10 as a bumble bee. One of ordinary skill in the art will understand that the solid bar of the locking arm 22 can be in any form that is desired by the manufacturer or designer.

As seen in FIGS. 2 and 6, in the preferred embodiment, the attachment device 14 includes a spring biased means mounted to the base 16 to move between a first position to a second position so that the clip 10 can releasably hold a portion of the article therebetween. Preferably, the spring biased means includes a torsion spring 48 to bias the locking arm 22 in the partially or fully closed position. The torsion spring 48 has a pair of legs, 50 and 52. During installation, leg 50 will rest against the base 16 and leg 52 is compressed from its free position to a loaded position. The loaded position is obtained when leg 52 is compressed toward leg 50 either before or as the locking arm 22 is pivotably mounted to pivot mounts 40 and 42. By compressing leg 52 toward leg 50, the angular deflection and modulus of elasticity of the torsion spring 48 causes leg 52 to attempt to return to its free, non-loaded position, thereby imposing an upward force against the actuator 46. The upward force imposed on the actuator 46 causes the locking arm 22 to rotate toward the closed position. The wire diameter, mean spring diameter, number of coils, distance between the axis of the spring and the point at which the load is applied by operating the actuator 46, are factors that should be considered in selecting the type of torsion spring to used. The torsion spring 48 selected should be capable of imposing a sufficient force against the actuator 46 to maintain the locking arm 22 in a partially or fully closed position. This, in turn, will cause a portion of the locking arm 22 to impose a force directed toward the base 16 to firmly, but releasably grasp or hold a portion of the article. The torsion spring 48 should not be stiff enough so that a person with modest or normal strength cannot operate the actuator 46 to load on the spring and rotate the locking arm 22 to open the clip 10.

As best seen in FIGS. 2, 4 and 7, a detent mechanism 54 releasably retains the locking arm 22 in the closed position. The detent mechanism 54 is a detent or stop 56 located and preferably formed about the distal end 26 of the locking arm 22. The detent 56 is shaped and dimensioned to be slidably received by a catch 58 on the surface 18 of the base 16. The catch 58 is formed by a circular wall 60 that defines a recess or cavity 62. The cavity 62 has a cross-section that is slightly larger than the cross-section of detent 56, which is used to guide the locking arm 22 into the closed position. The top portion of the wall 60 defines a shoulder 61 to cushion the distal end 26 when the locking arm 22 in the closed position. In operation, the detent mechanism 54 controls the distance in which the distal end 26 of the locking arm 22 travels toward the surface 18, thereby further defining the attachment region 28 and opening 20 of the clip 10.

The detent mechanism 54 is optional. It is contemplated that the detent mechanism 54 can be used as a means for releasably locking the locking arm 22 in position. It that type of embodiment, the cross-section of the cavity 62 should be slightly small than the cross-section of the detent 56 so that the detent 56 will snap-fit into the cavity 62. The cross-section of the cavity 62 should not be small enough so that the detent 56 cannot be released when the actuator 46 is operated. The detent mechanism 54 can be eliminated altogether, but the embodiment illustrated in the drawings is presently preferred.

Figure 3:
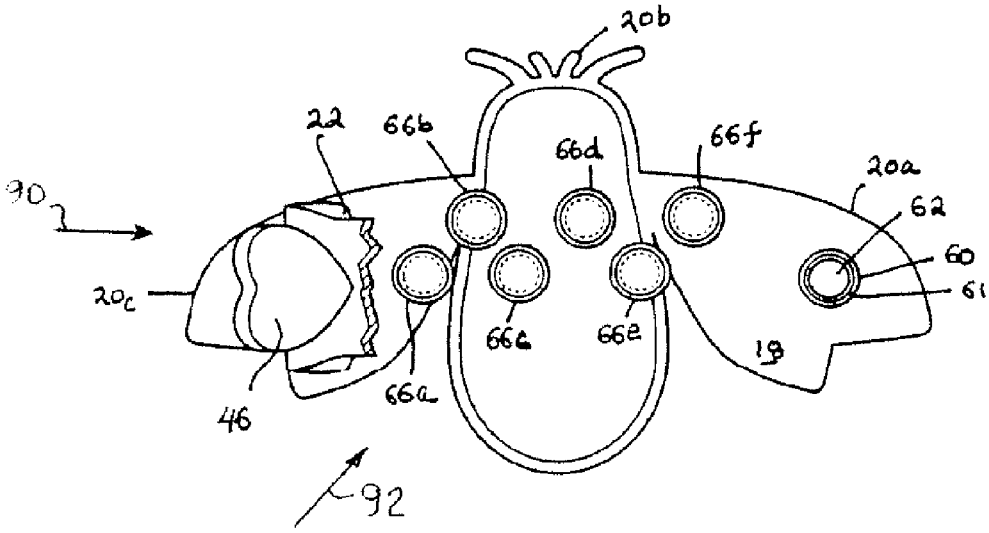
FIG. 3 is a rear plan view of the clip shown in FIG. 1, with a portion of the locking arm broken away to expose the projections.

As illustrated in FIGS. 2, 3 and 4, a plurality or group of projections 66*a*-66*f* (six shown) are on the base 16. The projections 66*a*-66*f* can be used a part of or to compliment the attachment 14. Projections 66*a*-66*f* project from the base toward said attachment device and are used as teeth to engage, grasp, hold fast and/or interlock with a portion of the article within region 28. As best seen in FIG. 3, the projections 66*a*-66*f* are spread apart from each other into an interlocking or engagement array to maximize the engaging capabilities of the clip 10. Each projection, such as 66*a*, has a tool or post 70*a* and a free end 67*a* that terminates in the same or a different plane from the free ends of the remaining projections 67*b*-67*f*, as best seen in FIG. 4. Because each projection 66*a*-66*f* has the same structure, a discussion of projection 66*a* will be representative of the other projections 66*b*-66*f*.

In FIGS. 2 and 3, the array of projections 66*a* through 66*f* preferably form a two dimensional array which defines two parallel rows (projections 66*b, d, f* form a first row and projections 66*a, c, e* form a second row) oriented from left to right in the drawing figure in a first direction 90 (horizontal, FIG. 3) and which projections form further rows that are also oriented in a second direction 92 from top to bottom of the drawing figure (inclined to the vertical, FIG. 3) transverse to the left and right direction 90 defining further parallel rows of two projections each extending inclined transversely to the two rows. Projections 66*a, b* form a third row, projections 66*c,d* form a fourth row and projections 66*e*, 66*f* form a fifth row, all of the latter three rows being parallel to each other and being inclined to the first and second rows. Each of the various rows of projections form sub arrays of the array of FIG. 3.

In a preferred embodiment, at least one projection includes a protective layer of relatively soft, friction engaging elastomeric material 68*a*, such as a rubber stopper (see FIGS. 2 and 4). The protective layer 68*a* is releasably secured to a tooth or post 70*a* (shown in phantom) that is joined to the base 16. The protective layer 68*a* forms a malleable, non-scratching surface that is advantageously used to grasp and/or hold a portion of the article. The protective layer 68*a* protects whatever article the clip 10 will be fastened to, such that the user will not have to worry about damaging or scratching the article. In addition, the protective layer 68*a* prevents the article from sliding through or from the attachment region 28. In use, the protective layer 68 assists in maintaining the clip 10 at the same position relative to an initial point of attachment to a portion of the article.

Figure 4A:
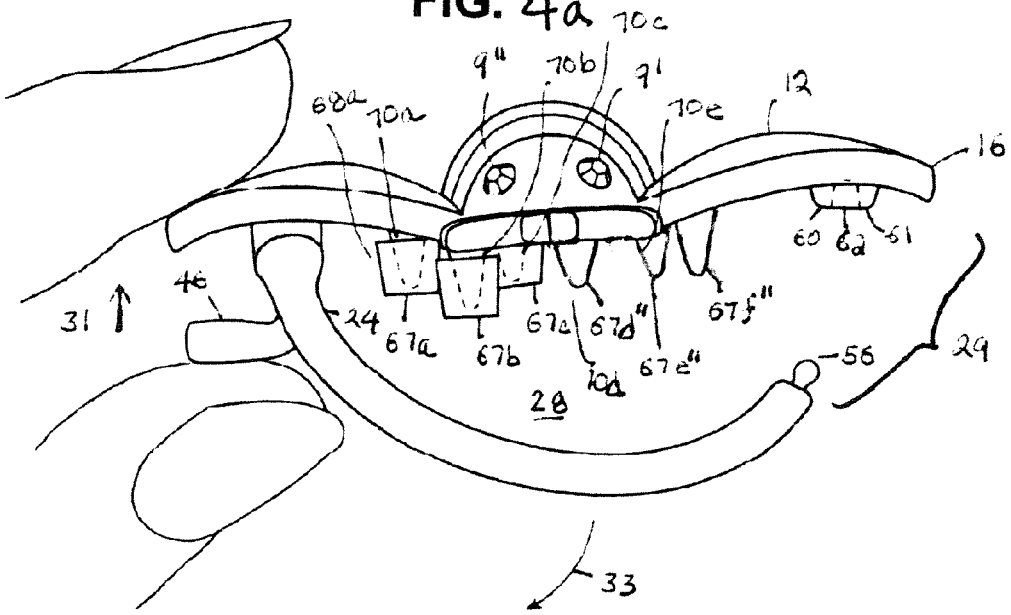

FIG. 4*a* shows a portion of the projections 67*d*", 67*e*" and 67*f*" having no protective layer thereon and forming sub arrays. The remaining projections have such a layer 68*a*-68*c*.

Preferably, the protective layer 68*a* is a thermoplastic elastomer having a durometer that ranges from about approximately 3 Shore to about approximately 60 Shore. Relatively soft, thermoplastic elastomeric material, such as rubber, is preferred to prevent damage (such as scratches) to the portion of the article that is engaged when the clip 10 is attached. Also, the material that is selected should have a relatively high coefficient of friction to prevent the clip from sliding off of the article. The properties of soft friction engaging material increases the versatility of the clip 10 because the protective layer 68*a* is used to grasp relatively hard, non-uniform shaped surfaces, such as beads of a string of pearls or links of a necklace, as two examples.

In a second preferred embodiment, projections 66*a*'-66*f*' (Only projections 68*a*', 68*c*' and 68*e*' are shown in FIG. 7. Projections with reference numerals having a prime (') represent similar structures as those structures having reference numerals without the prime). are coated with a protective layer 68*a*'-68*f*' of elastomeric material, as best seen in FIG. 7. It is contemplated that each projection can have a different shape, size and orientation. The projections 66*a*-66*f* and 66*a*'-66*f*' do not have to be aligned along the same axis in their respective embodiments. Rather, the orientation, alignment and the length to which the projections 66*a*-66*f* and 66*a*'-66*f*' extend from their respective bases 16 expands the grasping capabilities of the clip 10. The grasping capability is expanded because varying the angle or alignment of the projections provides a means to attach the clip 10 to a greater group of articles than is capable if the projections extend in the same direction, distance or have the same size and shape.

Either one or more of the projections 66*a*-66*f* are used in combination with the locking arm 22 to releasably attach the clip 10 to a portion of the article. To illustrate one example of how the clip 10 can be attached to an article, FIG. 5 shows the clip 10 attached to a necklace 72, e.g., a string of pearls 73. The pearls 73 are shown strewn around a women's neck. Each pearl has a relatively hard, outer surface or shell, having a relatively low coefficient of friction or effective contact area. The small size of the pearls makes it difficult, if not impossible, to attach the clip 10 using other fasteners, such as a prior art pins.

The clip 10 is attached to the pearls 723 using the attachment device 14 and projections 66*a*-66*f*, described above. It is contemplated that the clip 10 can be attached at different positions along the pearls 73. Likewise, the pearls 73 can be arranged in different configurations, but held in relatively the same position using the clip 10. Therefore, it should be understood that the combination of the clip 10 and string of pearls 73, as one example of an article, is advantageously used to enhance the appearance and attractiveness of the particular article that is being worn by an individual. Therefore, in keeping with the present invention, the overall attractiveness and appearance of articles such as bracelets, necklaces, scarfs, handbags, napkins, curtains, and the like can be rearranged or enhanced by using the clip 10 of the present invention.

Turing to FIG. 4 the clip 10 is attached to the pearls 73 by actuating the actuator 46, using a pinching action created by the user's index finger and thumb. As illustrated in FIG. 4, the tip of the thumb is used to move the actuator 46 toward the base 16 along direction 31. The moving action of the thumb causes the actuator 46 to impose a load or force on leg 52 of the torsion spring 48, thereby angularly deflecting leg 52 toward leg 50. In turn, the actuator 46 actuated the attachment device 14, causing the locking arm 22 to rotate away from the base 16 about the pivot mounts 40 and 42 in a clockwise direction, along arrow 33. As the locking arm 22 rotates, it will move from the closed position to an open position thereby opening the mouth or opening 29 of the clip 10. Operating the attachment device 14 between the closed and open position will expose the projections 66*a*-66*f* and attachment region 28 so that a portion of the article can be releasably attached therebetween.

Once the attachment device 14 is opened, the clip 10 is manipulated and moved along the pearls 73 until a position that is desired by the user is reached. To maintain the open position, the user continues to press the actuator 46 toward base 16 and firmly holds the actuator 46 in position once the degree in which the attachment device 14 is opened is achieved. Maintaining the actuator 46 in position will, in turn, continue to maintain leg 52 of the torsion spring 48 in the loaded, compressed position. Once the position along the pearls 73 is selected, the thumb is removed from the actuator 46. By removing the thumb, the torque created in legs 50 and 52 of the torsion spring 48 is released. In response, leg 52 will return to its unloaded position and cause the actuator 46 to return the locking arm 22 to a fully or partially closed position.

As shown in FIG. 6, the attachment device 14 engages a portion of the pearls 72 (shown in phantom) by interlocking with one or more of the projections 66*a*-66*c* (three shown). As best seen in FIGS. 7 and 8, individual pearls of the string of pearls 72 will become intertwined with the projections 66*a*, 66*c*, and 66*e*, engaging the protective layers 68*a*, 68*c* and 68*e*. The locking arm 22 is returned to is closed position, in which the detent 56 is slidably received in cavity 62. The torsion spring 48 maintains the locking arm 22 in the closed position, thereby causing the locking arm 22 to press individual pearls against the protective layer 68*a*, 68*c*, and 68*e* of the projections. The protective layer on the tooth of each projection cushions the impact of the pearls, thereby compressing against the protective layer 68*a*-68*f*, as illustrated in FIGS. 7, 8 and 9. Therefore, in keeping with the invention, using the protective layer 68*a*-68*f* form a cushioned, relatively tactile gripping surface that will grasp and hold a portion of the pearls in position, but not scratching or damaging them. The gripping action, along with the pressing force created by the locking arm 22, substantially reduces the likelihood that individual pearls will slide through the projections 66*a*-66*f*.

Therefore, the action of both the locking arm 22 and one or more of the projections 66*a*-66*f* allows the attachment device 14 to achieve a relatively firm grip on the article and to maintain the clip 10 in relatively the same place of its initial point of attachment. The clip 10 of the present invention, through the combination of the attachment device 14 and at least one of the projections 66*a*-66*f*, appreciably increases the ability of the clip 10 to attach to an article of jewelry, without causing damage similar to that created when pins or other prior art fasteners are used.

FIG. 10 illustrates the clip 10 being attached to the lapel of a blouse or jacket. As shown in FIG. 11, the locking bar is in a partially closed position. In the partially closed position, the detent 56 does not have to be received in the cavity 62 for the clip 10 to attach. Rather, the attachment device 14 will force the fabric 78 toward the end of the projections 66*a*-66*c* (three shown). The fabric will engage and rest against the protective layers 68*a*, 68*c* and 68*e* of the projections. Thus, the friction of the protective layer is advantageously used to prevent the fabric from sliding off of or through the projections so that the clip 10 will be held firmly in position relative to the article.

There are a number of ways in which the clip 10 can be used with jewelry or other specific articles. For example, whereas a pin is limited by the depth and the size of the opening formed by the needle portion and the catch, the clip 10 can accommodate multiple depths and widths relative to the article on which it is used. In other words, the mouth of the clip 10 created by the opening of the locking arm 22, can be opened wide enough to attach to different articles, but does not have to be locked in place similar to a pin in order for the clip 10 to hold fast to the portion of the article. Therefore, the clip 10 can be attached to articles and other jewelry that are have multiple shapes and sizes.

In summary, the clip 10 will be able to solve the limitations of prior art enhances and cable/pendent combinations that are attached at a single center position along a necklace. In addition, the clip 10 can be attached at any position along the necklace and is not limited to a center position. Furthermore, the clip 10 can be used by itself as a decorative accessory or it can be attached to a variety of articles, such as jewelry scarves, belts, pocketbooks, napkins, table decorations, curtains and the like. The versatility of the clip 10 is advantageously used to enhance the overall decorative appearance of articles worn or used by consumers. Therefore, the use and application of the clip 10 is not limited to jewelry, but can be used in any decorative fashion desired by the user.

Although the present invention has been descried in detail in connection with the illustration shown in the drawings, it is to be understood that such detail is solely for that purpose and that variations may be made by those skilled in the art without departing from the spirit of the invention.

Accordingly, the present invention provides an attachment device for an ornamental/decorative item, which can be maneuvered to attach to a variety articles and contact surfaces. The present invention also provides an attachment device for an ornamental item that can be attached to an article a different positions desired by the user. In addition, the present invention provides a clip for an ornamental item that is easy to use, is relatively inexpensive to manufacture, and can be worn as a fashion accessory on articles, such as pearls, beads, scarves, handbags, jewelry and the like.

The present invention may be embodied in other specific forms without departing from the spirit or essential attributes thereof and, therefore, reference should be made to the appended claims, rather than to the foregoing specification, as indicating the scope of the invention.

We claim:

1. A clip for an article comprising:

a base having an ornamental surface;

an attachment device secured to said base for movement between an open position and a closed position relative to said base to receive a portion of an article therebetween in the open position; and a plurality of discrete spaced apart stand-alone projections on said base projecting toward said attachment device in the closed position, said plurality of discrete separate spaced apart stand-alone projections each including a post, at least a portion of said plurality of posts having a separate discrete covering, wherein the at least a portion of said plurality of posts with their respective coverings each standing separately from one another in said spaced apart relation, said spaced apart projections being arranged in a two dimensional array comprising sub arrays of said projections extending in at least two different directions, such that the plurality of projections engage the received portion of the article with the attachment device in the closed position.

2. The clip as claimed in claim 1, wherein said projections comprise a first material, the projections each including said covering of a second material over and different from the first material for gripping said received portion of the article.

3. The clip as claimed in claim 1, wherein said projections comprise a first material, the projections each including said covering of a second material over and different from the first material for gripping said received portion of the article, said second material comprising a relatively soft, elastomeric material to frictionally engage, but not damage the received article.

4. The clip as claimed in claim 3, wherein said elastomeric material is a coating on the first material.

5. The clip as claimed in claim 1, wherein said projections comprise a first post material and wherein the covering comprises a layer of material on and over the first post material, the covering layer comprising a relatively soft and resilient material for non-damaging engagement with the portion of the received article.

6. The clip as claimed in claim 1 wherein said projections are formed as first and second parallel sub arrays that extend in respective transverse first and second directions.

7. The clip as claimed in claim 6, wherein said projections form at least two parallel rows in a first direction forming the first sub array, and form at least two additional parallel rows in a second direction transversely to the first direction forming the second sub array.

8. A method for providing a clip to attach to an article, the method comprising:

providing an ornamental member having a surface and an edge;

providing an attachment device mounted to the surface for moving between an open condition and a closed condition to selectively and releasably grasp a portion of the article;

providing a group of projections to engage a portion of the article, wherein a plurality of the projections each comprises a post on which there is a layer of elastomeric material to engage a portion of the article, said layer covering each of said plurality of posts to form a plurality of spaced apart discrete covered posts.

* * * * *